US011424599B2

(12) United States Patent
Tanahashi et al.

(10) Patent No.: US 11,424,599 B2
(45) Date of Patent: Aug. 23, 2022

(54) SPARK PLUG WITH INSULATOR WITH PARTICULAR SHAPE

(71) Applicant: NGK SPARK PLUG CO., LTD., Nagoya (JP)

(72) Inventors: Yusuke Tanahashi, Nagoya (JP); Naoki Nishio, Nagoya (JP); Yusuke Kawashima, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 23 days.

(21) Appl. No.: 16/973,599

(22) PCT Filed: Mar. 19, 2020

(86) PCT No.: PCT/JP2020/012264
§ 371 (c)(1),
(2) Date: Dec. 9, 2020

(87) PCT Pub. No.: WO2020/196245
PCT Pub. Date: Oct. 1, 2020

(65) Prior Publication Data

US 2021/0249846 A1 Aug. 12, 2021

(30) Foreign Application Priority Data

Mar. 25, 2019 (JP) ..... JP2019-056440

(51) Int. Cl.
*H01T 13/34* (2006.01)

(52) U.S. Cl.
CPC ..... *H01T 13/34* (2013.01)

(58) Field of Classification Search
CPC ..... H01T 13/20; H01T 13/34; H01T 13/36
See application file for complete search history.

(56) References Cited

U.S. PATENT DOCUMENTS 6,373,173 B1 * 4/2002 Suzuki ..... H01T 13/20 313/143
10,153,622 B1 12/2018 Uegaki et al.
(Continued)

FOREIGN PATENT DOCUMENTS

JP 02-027683 A 1/1990
JP 2013-524446 A 6/2013
(Continued)

OTHER PUBLICATIONS

Machine translation of WO 2016/174816 A1, retrieved from worldwide.espacenet.com on Feb. 23, 2022 (Year: 2022).*
(Continued)

*Primary Examiner* — Rajarshi Chakraborty
*Assistant Examiner* — Steven Y Horikoshi
(74) *Attorney, Agent, or Firm* — Kusner & Jaffe

(57) ABSTRACT

A spark plug including a center electrode that has a large-diameter portion having an outside diameter that is largest in the center electrode. The large-diameter portion is retained at a rear facing surface in an axial hole of an insulator. A metal shell has a diameter increased portion on a rear end side with respect to the center electrode, the diameter increased portion having an inside diameter that is increased toward the rear end side. The insulator has a first portion which is a portion of the insulator in a region from a rear end of the rear facing surface to a front end of the diameter increased portion. The first portion has a thickness that is the largest in the region, and is disposed at least on an outer periphery of the large-diameter portion.

8 Claims, 7 Drawing Sheets

(56) References Cited

U.S. PATENT DOCUMENTS

| | | | |
|---|---|---|---|
| 2011/0241525 | A1 | 10/2011 | Below |
| 2018/0358784 | A1 | 12/2018 | Uegaki et al. |

FOREIGN PATENT DOCUMENTS

| | | | | | |
|---|---|---|---|---|---|
| JP | 2019-3721 | A | | 1/2019 | |
| WO | WO-2016174816 | A1 | * | 11/2016 | ..... H01T 13/34 |

OTHER PUBLICATIONS

International Search Report from corresponding International Patent Application No. PCT/JP20/12264, dated Jun. 9, 2020.

* cited by examiner

SPARK PLUG WITH INSULATOR WITH PARTICULAR SHAPE

FIELD OF THE INVENTION

The present invention relates to a spark plug.

BACKGROUND OF THE INVENTION

A spark plug that is used for an internal combustion engine (engine), such as a spark plug disclosed in Japanese Patent Application Laid-open No. 2019-3721 ("PTL 1"), typically includes a cylindrical insulator having an axial hole extending in an axial direction, a cylindrical metal shell provided on the outer periphery of the insulator, and a rod-shaped center electrode extending in the axial direction. In the spark plug disclosed in PTL 1, the center electrode is disposed on a front end side in the axial hole formed in the insulator, and a ground electrode is provided on a front end side of the metal shell, so that a spark discharge is generated between the center electrode and the ground electrode.

In the spark plug of this type, a large-diameter portion having an outside diameter that is larger than that of the other portion is provided in a predetermined region of the center electrode in the axial direction. In addition, the axial hole of the insulator has a rear facing surface. The center electrode disposed in the axial hole is positioned such that the large-diameter portion is retained at the rear facing surface.

In recent years, an engine with increased supercharging, increased compression, and so forth, is suggested to improve fuel economy and to respond to environmental regulation. When this type of engine is used, the pressure in a combustion chamber is increased during operation of the engine, and hence the spark discharge voltage for generating a spark discharge is required to be increased. However, when the spark discharge voltage is increased, a spark that penetrates through the insulator (spark penetration) is more likely to occur between the large-diameter portion of the center electrode and the metal shell, possibly disrupting a normal spark discharge.

A method of suppressing such spark penetration may be increasing the thickness of the insulator to improve voltage resistance performance of the insulator. However, merely increasing the thickness of the insulator causes an increase in the diameter of the metal shell by the amount of the increase in the thickness of the insulator, consequently leading to an increase in the entire size of the plug.

SUMMARY OF THE INVENTION

The present invention is made to address at least one of the above-described problems, and an object of the invention is to provide a spark plug capable of further suppressing a spark that penetrates through an insulator while an increase in the diameter of a metal shell is suppressed.

Solution to Problem

A spark plug according to an aspect of the present invention includes a cylindrical insulator having an axial hole extending in an axial direction and a rear facing surface formed in the axial hole;

a cylindrical metal shell disposed on an outer periphery of the insulator; and a center electrode disposed on a front end side in the axial hole, the center electrode having a large-diameter portion having an outside diameter that is the largest in the center electrode, the large-diameter portion being retained at the rear facing surface, and the metal shell having a diameter increased portion on a rear end side with respect to the center electrode, the diameter increased portion having an inside diameter that is increased toward the rear end side, in which the insulator has a first portion that is a portion of the insulator in a region from a rear end of the rear facing surface to a front end of the diameter increased portion, the first portion has a thickness that is the largest in the region, and is disposed at least on an outer periphery of the large-diameter portion, the insulator is retained at the metal shell via a packing, on the front end side with respect to the first portion, and the insulator has a second portion on the rear end side with respect to the first portion in the region, the second portion having an outside diameter that is smaller than an outside diameter of the first portion.

In the spark plug, the first portion is disposed on a side close to the packing (a component that positions the insulator while being supported by the metal shell), and the second portion is disposed on a side farther from the packing than the first portion. Moreover, the first portion is disposed on the outer periphery of the large-diameter portion of the center electrode and has a larger thickness than that of the second portion.

With such a configuration, an effect of suppressing spark penetration can be increased in the vicinity of the large-diameter portion where a countermeasure for spark penetration is more required.

In addition, the side close to the packing has a feature that "the insulator is more stably held and the position thereof is hardly shifted relative to the metal shell". Thus, disposing the first portion on the side close to the packing can use this feature effectively. That is, on the side close to the packing, although the first portion having a relatively large outside diameter is disposed and hence the gap between the outer peripheral surface of the insulator (the outer peripheral surface of the first portion) and the inner peripheral surface of the metal shell is relatively small, the positional shift of the insulator is suppressed, and hence the insulator hardly comes into contact with the metal shell. Hence, on the side close to the packing, by using both the structure in which the position of the insulator is hardly shifted and the first portion together, prevention of the contact and suppression of spark penetration can be both provided.

In contrast, on the side far from the packing, the second portion having a relatively small outside diameter is disposed, and hence a larger gap is ensured between the outer peripheral surface of the insulator (the outer peripheral surface of the second portion) and the inner peripheral surface of the metal shell. That is, on the side far from the packing, the allowance for the positional shift of the insulator is larger, so that the insulator is less likely to come into contact with the metal shell even when the position of the insulator is shifted to some extent. Thus, the effect of preventing the contact can be increased.

In the spark plug, the first portion may be disposed at least on an outer periphery of a whole range in the axial direction of the center electrode in the region.

With the spark plug configured as described above, the whole range in the axial direction of a portion of the center electrode disposed in the region (the region from the rear end of the rear facing surface to the front end of the diameter increased portion) can be surrounded by the first portion. Thus, in the above-described portion where spark penetration possibly occurs, spark penetration can be further effectively suppressed, and voltage resistance performance can be further enhanced.

In the spark plug, an inside diameter of the insulator may be the smallest in the first portion in the region.

In the spark plug, the inside diameter of the insulator is the smallest in the first portion. Thus, the distance between the metal shell and the center electrode can be largely ensured while the thickness of the first portion is largely obtained, thereby suppressing the electrostatic capacity in the vicinity of the first portion. As a result, wear of the center electrode and the ground electrode can be suppressed.

In the spark plug, the metal shell may have an inside-diameter portion that is a portion of the metal shell in the region. The inside-diameter portion may have an inside diameter that is the largest in the region, and may be disposed at least on an outer periphery of the first portion.

With the spark plug, the portion of the metal shell disposed in the region (the region from the rear end of the rear facing surface to the front end of the diameter increased portion) and having the largest inside diameter (inside-diameter portion) is disposed at least on the outer periphery of the first portion. Thus, in the vicinity of the first portion, the distance between the metal shell and the center electrode is further largely ensured because of the presence of the inside-diameter portion, thereby further suppressing electrostatic capacity. Accordingly, wear of the center electrode and the ground electrode can be further suppressed. The inside-diameter portion (the portion having the largest inside diameter) is provided not in the entirety of the region (the region from the rear end of the rear facing surface to the front end of the diameter increased portion), but is selectively provided only in a portion of the region. Hence, a decrease in the strength of the metal shell is suppressed compared with a configuration in which the inside-diameter portion is provided in the whole range of the region.

In the spark plug, a portion in the axial hole, on the rear end side with respect to the rear facing surface, may be filled with a front seal member that is in contact with an inner peripheral surface of the insulator and the center electrode and that contains an electrically conductive material. The first portion may be disposed at least in a region from the rear end of the rear facing surface to a rear end of the front seal member.

In a spark plug in which the gap between an insulator and a center electrode is filled with an electrically conductive front seal member, since the front seal member is electrically conductive, the front seal member transmits a spark from the center electrode, and the spark reaches the insulator. When the energy of the spark is high, the spark may penetrate through the insulator and a discharge may occur. However, in the above-described spark plug, since the thickness of the insulator is increased in the vicinity of the center electrode and the front seal member, occurrence of spark penetration can be suppressed.

Advantageous Effects of Invention

According to the present invention, a spark plug capable of further suppressing a spark that penetrates through an insulator while an increase in the diameter of a metal shell is suppressed can be provided.

DETAILED DESCRIPTION OF THE INVENTION

First Embodiment

1. General Configuration of Spark Plug

Figure 1:
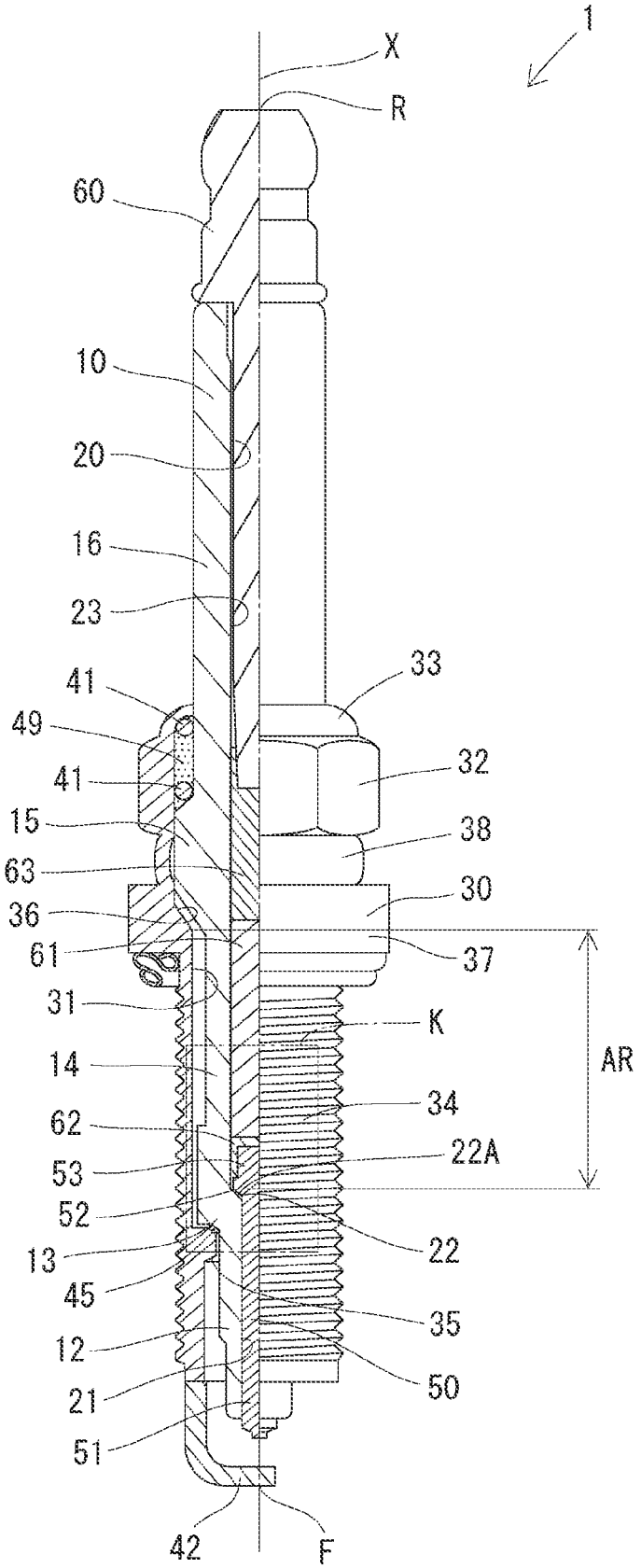
FIG. 1 is a partial sectional view illustrating a spark plug according to a first embodiment.

A spark plug 1 according to a first embodiment illustrated in FIG. 1 is installed in an internal combustion engine (not illustrated) and is used for igniting a combustion gas in a combustion chamber of the internal combustion engine. The spark plug 1 includes an insulator 10, a metal shell 30, a center electrode 50, a metal terminal 60, and a resistor 61. In the specification, a direction along an axial line X (central axis) of the spark plug 1 is referred to as an axial direction. In the axial direction, a side on which a ground electrode 42 is provided is referred to as a front end side, and a side opposite thereto (a side on which the metal terminal 60 is exposed to the outside of the insulator 10) is referred to as a rear end side. In FIG. 1, a front end (front tip end) of the spark plug 1 is indicated by reference sign F, and a rear end of the spark plug is indicated by reference sign R. For each component, a lower side in FIG. 1 is referred to as the front end side and an upper side is referred to as the rear end side in the following description. Moreover, the axial direction is also referred to as a front-rear direction. The front end side is also referred to as a front side and the rear end side is also referred to as a rear side.

As illustrated in FIG. 1, the insulator 10 is a cylindrical member having an axial hole 20 extending in the axial direction. The insulator 10 is formed by firing an insulating ceramic material, for example, alumina. The insulator 10 is fixed in a state inserted in a through hole 31 of the metal shell 30. The front end of the insulator 10 projects toward the front end side with respect to the front end of the metal shell 30. The rear end of the insulator 10 projects toward the rear end side with respect to the rear end of the metal shell 30.

As illustrated in FIG. 1, the axial hole 20 is constituted as a hole section into which the center electrode 50, the metal terminal 60, the resistor 61, a front seal member 62, a rear seal member 63, and so forth, are inserted. The axial hole 20 extends through the insulator 10 in the axial direction to extend from the front end to the rear end of the insulator 10. The axial hole 20 has a small-diameter hole portion 21, a step portion 22, and a large-diameter hole portion 23 in this order from the front end side.

As illustrated in FIG. 1, the inside diameter of the small-diameter hole portion 21 is smaller than the inside diameter of the large-diameter hole portion 23. The rear end of the small-diameter hole portion 21 is located at the front end of the step portion 22. The front end of the small-diameter hole portion 21 is located at the front end of the insulator 10. The inside diameter of the small-diameter hole portion 21 is constant in a predetermined region in the axial direction (a range from the front end of the step portion 22 to the front end of the insulator 10). The front end of the large-diameter hole portion 23 is located at the rear end of the step portion 22. The rear end of the large-diameter hole portion 23 is located at the rear end of the insulator 10. The inside diameter of the large-diameter hole portion 23 is constant in a predetermined range from the rear end of the step portion 22 to a position close to the rear end of the insulator 10.

As illustrated in FIG. 1, the step portion 22 is provided between the small-diameter hole portion 21 and the large-diameter hole portion 23, and has a slanted surface (rear facing surface 22A) slanted such that the inside diameter is decreased from the rear end side toward the front end side. The rear facing surface 22A is a surface that faces the rear end side of the spark plug 1, is formed in a front trunk portion 14, and is provided to face the axial line X side (to face obliquely inward). The rear facing surface 22A is a tapered surface slanted such that the outside diameter (the diameter in a cut section orthogonal to the axial line X) is gradually increased toward the rear end side.

Figure 2:
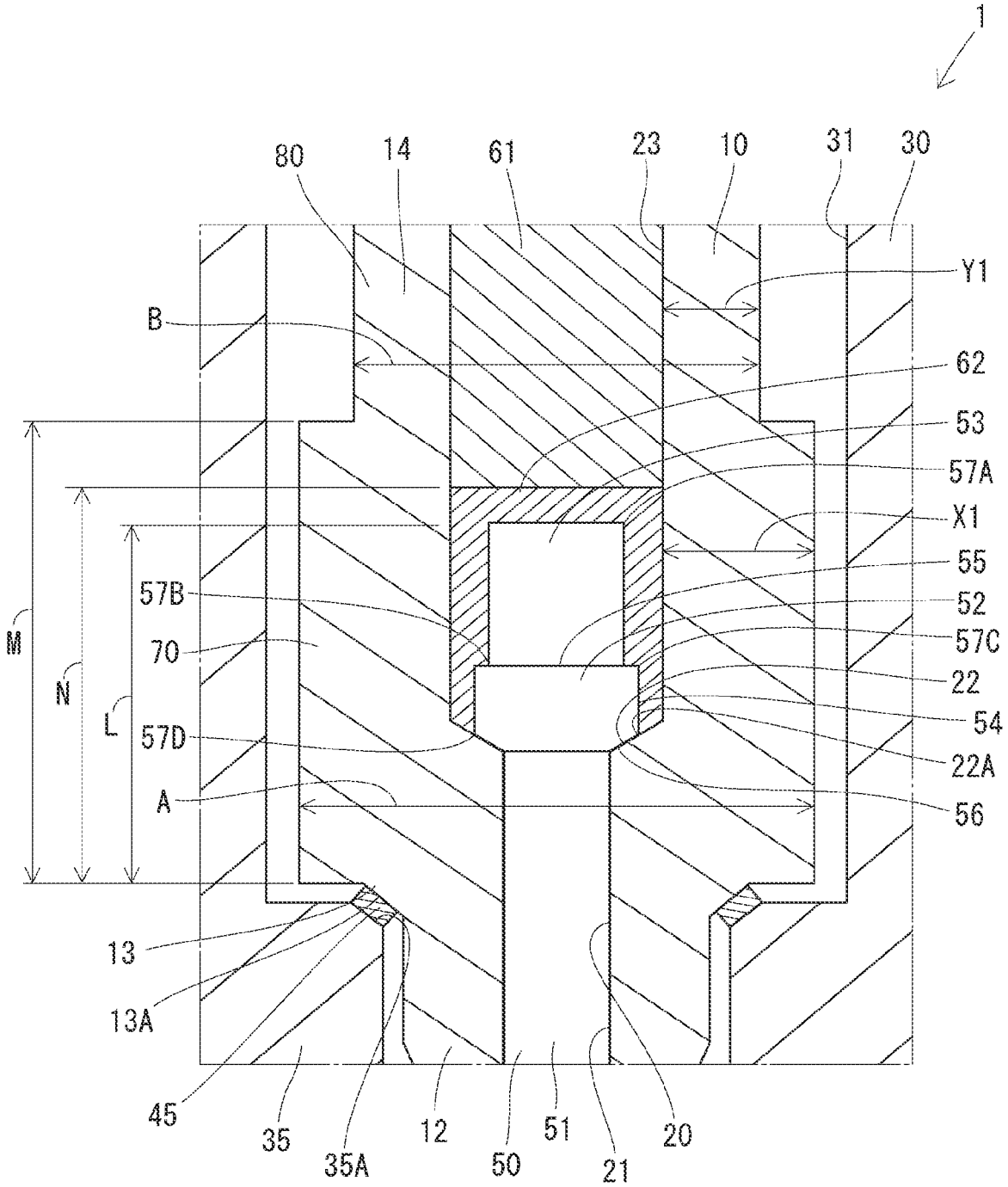
FIG. 2 is an enlarged sectional view illustrating part of the spark plug in FIG. 1 in an enlarged manner and is a sectional view corresponding to a section surrounded by a one-dot chain line K in FIG. 1.

A portion of the insulator 10 surrounding the center electrode 50 has a step portion 13 (FIG. 2). The step portion 13 is retained at a projecting portion 35 of the metal shell 30 via an annular packing 45. The step portion 13 has a slanted surface 13A (FIG. 2) slanted such that the diameter is decreased toward the front end side.

As illustrated in FIG. 1, the insulator 10 has a leg portion 12 provided on the front end side with respect to the step portion 13 (FIG. 2), and has the front trunk portion 14 provided on the rear end side with respect to the step portion 13. The leg portion 12 is a portion extending in the axial direction to be continuous from the front end position of the step portion 13 to the front end side in the axial direction. The leg portion 12 is a portion that is exposed to a combustion chamber in a state in which the spark plug 1 is installed in the internal combustion engine. The leg portion 12 is thinner than the front trunk portion 14. The front trunk portion 14 is a portion that continues to extend along the axial direction from the rear end position of the step portion 13 to the front end position of a flange portion 15 in the axial direction.

As illustrated in FIG. 1, the insulator 10 has the flange portion 15 provided on the rear end side with respect to the front trunk portion 14. The flange portion 15 is located substantially at the center of the insulator 10 in the axial direction, and has a flange form protruding outward in the radial direction with respect to the front trunk portion 14 and a rear trunk portion 16.

As illustrated in FIG. 1, the insulator 10 has the rear trunk portion 16 provided on the rear end side with respect to the flange portion 15. The outer peripheral surface of the rear trunk portion 16 is a cylindrical surface centered on the axial line X. The outside diameter (the diameter of the outer peripheral surface) of the rear trunk portion 16 is constant in a predetermined range from the rear end of the flange portion 15. The outside diameter of the flange portion 15 is larger than the outside diameters of the front trunk portion 14 and the rear trunk portion 16.

The metal shell 30 is formed of an electrically conductive metal material (for example, low-carbon steel). The metal shell 30 is a metal part for fixing the spark plug 1 to an engine head of the internal combustion engine. The metal shell 30 has a cylindrical shape having the through hole 31 extending therethrough in the axial direction. The metal shell 30 is disposed on the outer periphery of the insulator 10, and is fixed to the insulator 10 by crimping.

As illustrated in FIG. 1, the metal shell 30 includes a tool engagement portion 32 which is engaged with a tool (spark plug wrench) for installing the metal shell 30 on the engine head. The outer peripheral surface of the tool engagement portion 32 has a polygonal shape with which the tool is engaged. A thin crimping portion 33 is provided on the rear side of the tool engagement portion 32. The crimping portion 33 comes into close contact with the rear trunk portion 16 of the insulator 10 when the metal shell 30 is crimped to the insulator 10.

As illustrated in FIG. 1, the metal shell 30 has a screw portion 34 (external thread portion) to be inserted into a screw hole (internal thread portion, not illustrated) provided in the internal combustion engine and fixed therein. A thread groove (external thread groove) is formed in the outer peripheral surface of the screw portion 34. The projecting portion 35 is formed in the inner peripheral surface of the screw portion 34 so as to protrude inward over the entire circumferential direction. The projecting portion 35 functions to sandwich the packing 45 together with the step portion 13 (FIG. 2) provided in the insulator 10.

As illustrated in FIG. 1, the metal shell 30 includes a flange-shaped seat portion 37 on the rear end side of the screw portion 34. A thin compression deformation portion 38 is provided between the seat portion 37 and the tool engagement portion 32. A filled portion 49 is provided between the inner peripheral surfaces of the tool engagement portion 32 and the crimping portion 33, and the outer peripheral surface of the rear trunk portion 16 of the insulator 10. The filled portion 49 is filled with powder of talc (talc powder). The filled portion 49 is sealed with annular seal members (linear packings) 41.

As illustrated in FIG. 1, a diameter increased portion 36 whose inside diameter is increased is provided at the inner peripheral portion of the seat portion 37 of the metal shell 30. The diameter increased portion 36 is disposed on the rear end side with respect to the center electrode 50 and has the inside diameter that is increased toward the rear end side. The diameter increased portion 36 is formed such that the inside diameter is gradually increased from the front end side toward the rear end side in the seat portion 37. The inner peripheral surface of the diameter increased portion 36 is a tapered surface slanted such that the inside diameter (the diameter in a cut section orthogonal to the axial line X) is gradually increased toward the rear end side. The front end position of the above-described tapered surface (slanted surface) in the axial direction corresponds to an example of the front end position of the diameter increased portion 36. The flange portion 15 is partly disposed inside the diameter increased portion 36.

The insulator 10 is pressed toward the front end side in the through hole 31 via the seal members 41 and the talc due to compression deformation of the compression deformation portion 38 of the metal shell 30. The packing 45 is in close contact with a slanted surface (projecting-portion slanted surface) 35A of the projecting portion 35 facing the rear end side and a slanted surface (step-portion slanted surface) 13A of the step portion 13 facing the front end side, and is sandwiched between the slanted surfaces 35A and 13A. With the configuration in which the packing 45 is thus sandwiched, the gas in the combustion chamber is prevented from leaking to the rear end side through a gap between the metal shell 30 and the insulator 10.

The ground electrode 42 is joined to the front end of the metal shell 30, for example, by resistance welding. A spark gap which is a gap for generating a spark is formed between the ground electrode 42 and the center electrode 50.

The center electrode 50 is formed by using a metal having high corrosion resistance and high heat resistance, for example, nickel (Ni) or an alloy containing nickel as the major component. The center electrode 50 has a rod shape extending in the axial direction, and is disposed on the front end side in the axial hole 20 of the insulator 10. The front end of the center electrode 50 projects to the front end side with respect to the front end of the insulator 10. The rear end of the center electrode 50 is located in the front trunk portion 14.

The center electrode 50 includes a leg portion 51, a large-diameter portion 52, and a head portion 53 in this order from the front end side in the axial direction. The outside diameter of the large-diameter portion 52 is larger than the outside diameter of the leg portion 51 and the outside diameter of the head portion 53. The large-diameter portion 52 is a portion having an outside diameter that is the largest in the center electrode 50, and is retained at the rear facing surface 22A of the insulator 10. The large-diameter portion 52 has a columnar portion 54 having an outside diameter (the diameter of the outer peripheral surface) that is constant in a predetermined range in the axial direction, and a tapered portion 56 having an outside diameter that is gradually decreased toward the front end side. The outside diameter of the columnar portion 54 is the largest in the center electrode 50. The rear end of the columnar portion 54 is a rear end 55 of the large-diameter portion 52. The rear end 55 is located at the same position as the position of the front end of the head portion 53 in the axial direction. The tapered portion 56 is a portion that is in contact with and supported by the rear facing surface 22A, and is a portion continuous from the front end of the columnar portion 54 toward the front end side.

The metal terminal 60 is formed of an electrically conductive metal material (for example, low-carbon steel). The metal terminal 60 is a rod-shaped member extending in the axial direction, and is disposed on the rear end side in the axial hole 20 of the insulator 10. A rear end portion of the metal terminal 60 projects to the rear end side with respect to the insulator 10. A high voltage for generating a spark discharge is applied to the metal terminal 60 from a power supply member.

The resistor 61 is disposed in the axial hole 20, between the center electrode 50 and the metal terminal 60. The resistor 61 is formed of a composition containing, for example, an electrically conductive material, glass particles, and ceramic particles other than the glass particles.

In the axial hole 20, the gap between the resistor 61 and the center electrode 50 is filled with the front seal member 62 containing an electrically conductive material. The filling with the front seal member 62 is provided in the axial hole 20 on the rear end side with respect to the rear facing surface 22A. The front seal member 62 is in contact with the inner peripheral surface of the insulator 10, the center electrode 50, and the resistor 61. The front seal member 62 separates the center electrode 50 and the resistor 61 from each other. The front seal member 62 is a member that seals and fixes the insulator 10 and the center electrode 50.

In the axial hole 20, the gap between the resistor 61 and the metal terminal 60 is filled with the rear seal member 63 which is electrically conductive. The rear seal member 63 is in contact with the metal terminal 60 and the resistor 61 and separates the metal terminal 60 and the resistor 61 from each other. The rear seal member 63 is a member that seals and fixes the insulator 10 and the metal terminal 60. The front seal member 62 and the rear seal member 63 electrically and physically connect the center electrode 50 and the metal terminal 60 to each other via the resistor 61. The front seal member 62 and the rear seal member 63 are formed of an electrically conductive material, for example, a composition containing glass particles and metal particles.

2. Specific Configurations of Insulator and Other Components

The specific configurations of the insulator and other components are described below in detail.

In the insulator 10, the front trunk portion 14 has a feature configuration. The front trunk portion 14 is a portion disposed so as to continue from the rear end position of the step portion 13 to the front end position of the flange portion 15 in the axial direction. At least a portion of the front trunk portion 14 is disposed inside the screw portion 34 of the metal shell 30. The front trunk portion 14 includes a first portion 70 having an outer peripheral surface that constitutes a first structure, and a second portion 80 having an outer peripheral surface that constitutes a second structure.

The first portion 70 is a portion of the insulator 10 in a region AR from the rear end of the rear facing surface 22A to the front end of the diameter increased portion 36. The first portion 70 has a thickness that is the largest in the region AR, and is disposed at least on the outer periphery of the large-diameter portion 52. Specifically, the first portion 70 is disposed on the outer periphery of the whole range in the axial direction of the center electrode 50 in the region AR. In the axial direction, the rear end of the first portion 70 is located on the rear end side with respect to the rear end 55 of the large-diameter portion 52 and is located on the rear end side with respect to the rear end of the center electrode 50. The front end of the first portion 70 is located on the front end side with respect to the front end of the large-diameter portion 52 and is located on the front end side with respect to the rear end of the rear facing surface 22A. The first portion 70 is disposed at least in a region from the rear end of the rear facing surface 22A to the rear end of the front seal member 62.

A length M of the first portion 70 in the axial direction is larger than a length N from the rear end of the step portion 13 to the rear end of the front seal member 62 in the axial direction, and is larger than a length L from the rear end of the step portion 13 to the rear end of the center electrode 50 in the axial direction. The rear end of the front seal member 62 is located on the rear end side with respect to the rear end of the center electrode 50. The rear end of the first portion 70 is located on the rear end side with respect to the rear end of the front seal member 62. The front end of the first portion 70 is located on the front end side with respect to the front end of the front seal member 62.

The first portion 70 is disposed on the rear end side with respect to the packing 45. That is, the insulator 10 is retained at the metal shell 30 via the packing 45, on the front end side with respect to the first portion 70.

In the region AR, the inside diameter of the insulator 10 is constant in the axial direction. The bore of the insulator 10 is a cylindrical surface centered on the axial line X in the whole range of the region AR in the axial direction, and the inside diameter of the insulator 10 is constant in the whole range of the region AR. Thus, in the region AR, the inside diameter of the insulator 10 is the smallest in the first portion 70.

The second portion 80 is a portion of the insulator 10 disposed on the rear end side with respect to the first portion 70 in the region AR, and is a portion having an outside diameter B that is smaller than an outside diameter A of the first portion 70.

In the axial direction, the position of the rear end of the first portion 70 is the same as the position of the front end of the second portion 80, and the position of the front end of the first portion 70 is the same as the position of the rear end of the step portion 13 (the position of the rear end of the slanted surface 13A). In the axial direction, the position of the rear end of the second portion 80 is the same as the position of the front end of the flange portion 15 (the position of the front end of the slanted surface provided on the front end side of the flange portion 15), and the position of the front end of the second portion 80 is the same as the position of the rear end of the first portion 70.

The outside diameter A (the diameter of the outer peripheral surface) of the first portion 70 is larger than the outside diameter B (the diameter of the outer peripheral surface) of the second portion 80. The outer peripheral surface of the first portion 70 is a cylindrical surface centered on the axial line X. The outer peripheral surface of the second portion 80 is a cylindrical surface centered on the axial line X. The outside diameter A of the first portion 70 and the outside diameter B of the second portion 80 are larger than the outside diameter (the diameter of the outer peripheral surface) of the leg portion 12. The outside diameter A of the first portion 70 is constant from the rear end of the step portion 13 to the front end of the second portion 80 in the axial direction. At any position in the axial direction, a cut section of the first portion 70 cut in a direction orthogonal to the axial line X has a circular external shape centered on the axial line X with the predetermined diameter A (the same diameter). The outside diameter B of the second portion 80 is constant from the rear end of the first portion 70 to the front end of the flange portion 15 in the axial direction. At any position in the axial direction, a cut section of the second portion 80 cut in a direction orthogonal to the axial line X has a circular external shape centered on the axial line X with the predetermined diameter B (the same diameter).

3. Examples of Effects

In the spark plug 1, the first portion 70 is disposed on a side close to the packing 45 (a component that positions the insulator 10 while being supported by the metal shell 30), and the second portion 80 is disposed on a side farther from the packing 45 than the first portion 70. Moreover, a thickness X1 of the first portion 70 in the radial direction is larger than a thickness Y1 of the second portion 80 in the radial direction. The first portion 70 is disposed on the outer periphery of the large-diameter portion 52 and has a larger thickness than that of the second portion 80.

With such a configuration, an effect of suppressing spark penetration can be increased in the vicinity of the large-diameter portion 52 where a countermeasure for spark penetration is more required.

In addition, the side close to the packing 45 has a feature that "the insulator 10 is more stably held and the position thereof is hardly shifted relative to the metal shell 30". Thus, disposing the first portion 70 on the side close to the packing 45 can use this feature effectively. That is, on the side close to the packing 45, although the first portion 70 having a relatively large outside diameter is disposed and hence the gap between the outer peripheral surface of the insulator 10 (the outer peripheral surface of the first portion 70) and the inner peripheral surface of the metal shell 30 is relatively small, the insulator 10 hardly comes into contact with the metal shell 30. Hence, on the side close to the packing 45, by using the structure in which the position of the insulator 10 is hardly shifted and the first portion 70 both together, prevention of contact and suppression of spark penetration can be both provided.

In contrast, on the side far from the packing 45, the second portion 80 having a relatively small outside diameter is disposed, and hence a larger gap is ensured between the outer peripheral surface of the insulator 10 (the outer peripheral surface of the second portion 80) and the inner peripheral surface of the metal shell 30. That is, on the side far from the packing 45, the allowance for the positional shift of the insulator 10 is larger, so that the insulator 10 is less likely to come into contact with the metal shell 30 even when the position of the insulator 10 is shifted to some extent. Thus, the effect of preventing the contact can be increased.

With such a configuration, when a vibration or the like is applied during use of the spark plug 1, a situation in which the insulator 10 comes into contact with the metal shell 30 is less likely to occur in the vicinity of either of the first portion 70 and the second portion 80.

In the spark plug 1, the first portion 70 is disposed at least on the outer periphery of the whole range in the axial direction of the center electrode 50 in the region AR. In the spark plug 1, the whole range in the axial direction of "a portion of the center electrode 50 disposed in the region AR" can be surrounded by the first portion 70. Thus, in the above-described portion where spark penetration possibly occurs, spark penetration can be further effectively suppressed, and voltage resistance performance can be further enhanced.

Specifically, the first portion 70 is disposed outside of edge portions 57A, 57B, 57C, and 57D to surround all the edge portions 57A, 57B, 57C, and 57D at which spark penetration is likely to start. Thus, spark penetration can be further effectively suppressed. The edge portion 57A is an outer peripheral edge at the rear end of the center electrode 50 (the rear end of the head portion 53). The edge portion 57B is an outer peripheral edge at the front end of the head portion 53. The edge portion 57C is an outer peripheral edge at the rear end of the large-diameter portion 52. The edge portion 57D is an outer peripheral edge at the front end of the columnar portion 54 of the large-diameter portion 52.

In the spark plug 1, since the inside diameter of the insulator 10 is the smallest in the first portion 70, the distance between the metal shell 30 and the center electrode 50 can be largely ensured while the thickness of the first portion 70 is largely obtained, thereby suppressing the electrostatic capacity in the vicinity of the first portion 70. As a result, wear of the center electrode 50 and the ground electrode 42 can be suppressed.

In the spark plug 1, the portion in the axial hole 20 on the rear end side with respect to the rear facing surface 22A is filled with the front seal member 62 containing an electrically conductive material. The front seal member 62 is in contact with the inner peripheral surface of the insulator 10, and the center electrode 50. The first portion 70 is disposed in a region from the rear end of the rear facing surface 22A to the rear end of the front seal member 62. Ina spark plug in which the gap between an insulator and a center electrode is filled with an electrically conductive front seal member, since the front seal member is electrically conductive, the front seal member transmits a spark from the center electrode, and the spark reaches the insulator. When the energy of the spark is high, the spark may penetrate through the insulator and a discharge may occur. However, in the spark plug 1, since the thickness of the insulator 10 is increased in the vicinity of the center electrode 50 and the front seal member 62, occurrence of spark penetration can be suppressed.

Second Embodiment

A spark plug 201 according to a second embodiment is described next mainly with reference to FIG. 3.

Figure 3:
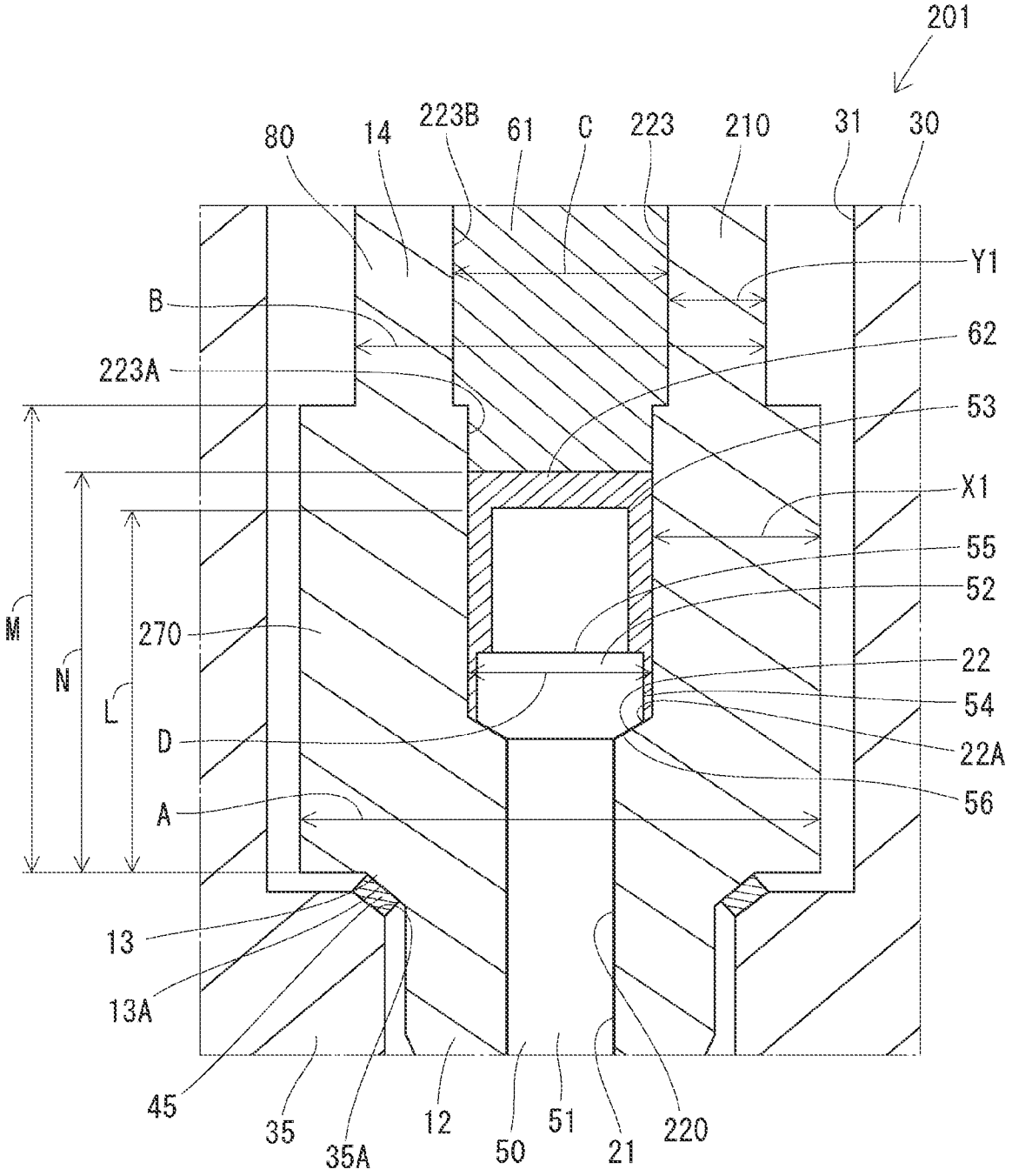
FIG. 3 is an enlarged sectional view illustrating part of a spark plug according to a second embodiment in an enlarged manner.

The spark plug 201 according to the present embodiment illustrated in FIG. 3 is the same as the spark plug 1 according to the first embodiment except that the insulator 10 (FIG. 2) is changed to an insulator 210. Specifically, the spark plug 201 is the same as the spark plug 1 according to the first embodiment except that the axial hole 20 (FIG. 2) is changed to an axial hole 220. Hence, the same reference sign is applied to the configuration similar to that of the first embodiment, and the redundant description is omitted. For example, the configuration in FIG. 1 other than the inner structure indicated by the region K is the same as that of the spark plug 1 illustrated in FIG. 1. In the following description, the region other than the region in FIG. 3 is described with reference to FIG. 1 if needed.

The spark plug 201 illustrated in FIG. 3 differs from the spark plug 1 (FIG. 2) only in that the large-diameter hole portion 23 (FIG. 2) is changed to a large-diameter hole portion 223. Specifically, the spark plug 201 differs from the spark plug 1 (FIG. 2) only in that an inside diameter D of a first portion 270 in the whole range on the rear end side with respect to the rear facing surface 22A is smaller than an inside diameter C of the second portion 80.

In the spark plug 201 illustrated in FIG. 3, the inside diameter of the insulator 210 in the region AR (the region from the rear end of the rear facing surface 22A to the front end of the diameter increased portion 36 (FIG. 1) in the axial direction) is the smallest in the first portion 270. The second portion 80 has the same shape as that of the second portion 80 of the spark plug 1 (FIG. 2). The first portion 270 differs from the first portion 70 (FIG. 2) only in that the inside diameter of the first portion 270 in the region AR is smaller than the inside diameter of the first portion 70 of the spark plug 1 (FIG. 2) in the region AR. The inner peripheral surface of the first portion 270 is a cylindrical surface 223A having the constant inside diameter D centered on the axial line X on the rear end side with respect to the rear facing surface 22A. An inner peripheral surface 223B of the second portion 80 is a cylindrical surface having the constant inside diameter C centered on the axial line X. The inside diameter D is smaller than the inside diameter C. The rear end of the cylindrical surface 223A having the constant inside diameter D may be located at the position of the rear end of the first portion 270, may be located on the front end side with respect to the rear end of the first portion 270, or may be located on the rear end side with respect to the rear end of the first portion 270.

The spark plug 201 configured as described above also attains an advantageous effect similar to that of the spark plug 1 (FIG. 2) in regard to the feature similar to that of the spark plug 1.

Furthermore, in the spark plug 201, the inside diameter of the insulator 210 in the region AR is the smallest in the first portion 270. Specifically, a portion of the first portion 270 having the inside diameter D that is smaller than the inside diameter C of a second portion 280 is provided in the region AR. Thus, the thickness of the first portion 270 can be further sufficiently ensured, and the electrostatic capacity in the vicinity of the first portion 270 can be further suppressed.

Third Embodiment

A spark plug 301 according to a third embodiment is described next mainly with reference to FIG. 4.

Figure 4:
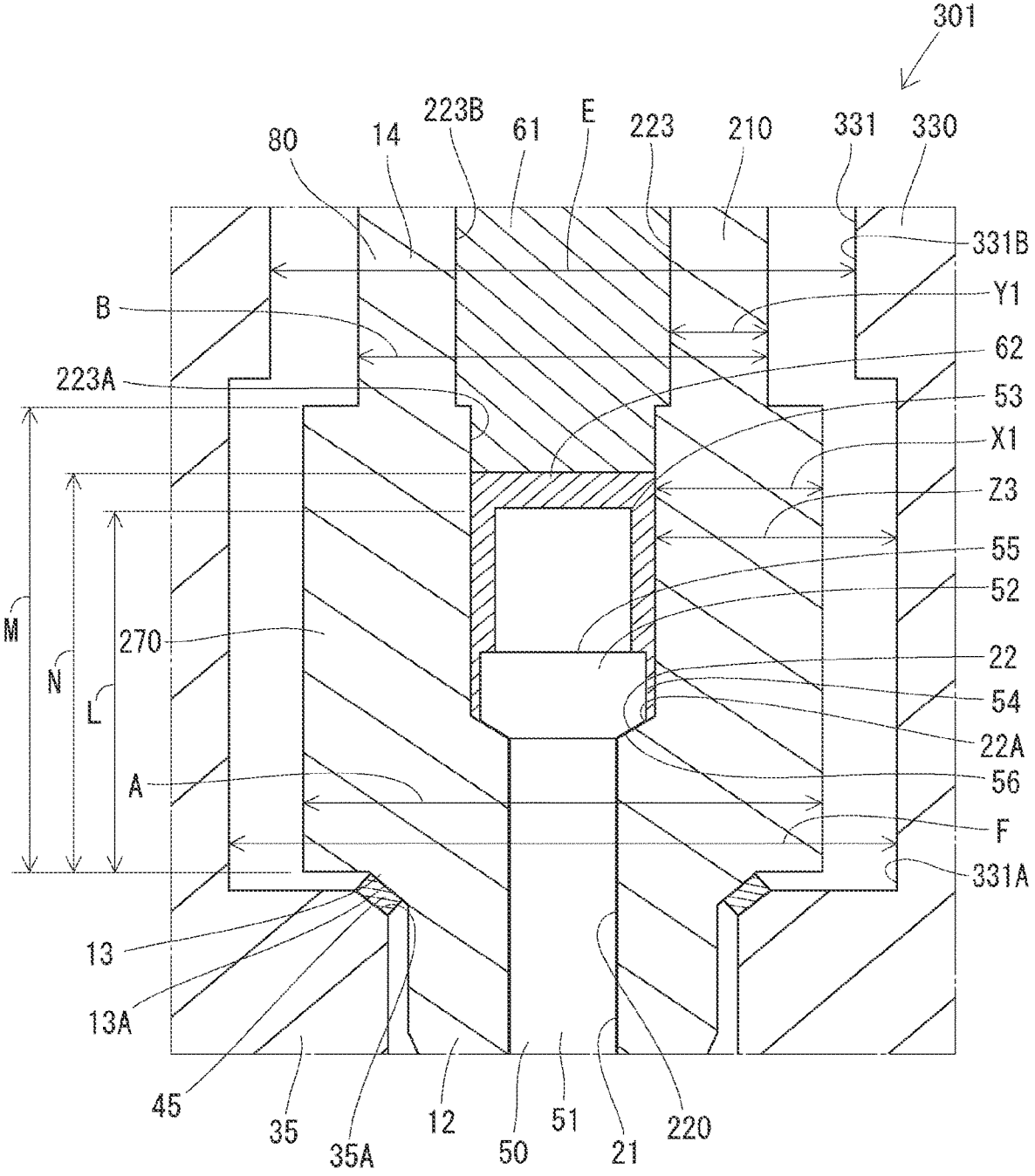
FIG. 4 is an enlarged sectional view illustrating part of a spark plug according to a third embodiment in an enlarged manner.

The spark plug 301 according to the present embodiment illustrated in FIG. 4 is the same as the spark plug 201 according to the second embodiment except that the metal shell 30 (FIG. 3) is changed to a metal shell 330. Specifically, the spark plug 301 is the same as the spark plug 201 according to the second embodiment except that the through hole 31 (FIG. 3) is changed to a through hole 331. Hence, the same reference sign is applied to the configuration similar to that of the second embodiment, and the redundant description is omitted. For example, the configuration in FIG. 1 other than the inner structure indicated by the region K is the same as that of the spark plug 1 illustrated in FIG. 1. In the following description, the region other than the region in FIG. 4 is described with reference to FIG. 1 if needed.

The metal shell 330 of the spark plug 301 illustrated in FIG. 4 differs from the metal shell 30 of the spark plug 201 (FIG. 3) only in that a first inside-diameter portion 331A having a first inside diameter F and a second inside-diameter portion 331B having a second inside diameter E are provided in the region AR, instead of the configuration in which the inner peripheral portion has the constant inside diameter in the region AR.

As illustrated in FIG. 4, the first inside-diameter portion 331A constitutes a portion of the metal shell 330 in the region AR (FIG. 1), and has an inside diameter that is larger than that of the second inside-diameter portion 331B constituting another portion of the metal shell 330 in the region AR. The first inside-diameter portion 331A corresponds to an example of an inside-diameter portion, and is a portion having the largest inside diameter in a portion of the metal shell 330 in the region AR (FIG. 1). It is sufficient that the first inside-diameter portion 331A is disposed at least on the outer periphery of the first portion 70. In the example in FIG. 4, the first inside-diameter portion 331A is disposed so as to surround the whole range in the axial direction of the first portion 70.

The inner peripheral surface of the first inside-diameter portion 331A is a cylindrical surface having the constant inside diameter F centered on the axial line X on the rear end side with respect to the step portion 13. The inner peripheral surface of the second inside-diameter portion 331B is a cylindrical surface having the constant inside diameter E centered on the axial line X on the rear end side with respect to the first inside-diameter portion 331A. Either of the inside diameter F and the inside diameter E is larger than either of the outside diameter A and the outside diameter B. The inside diameter F is larger than the inside diameter E. It is desirable that the rear end of the first inside-diameter portion 331A is disposed at a position on the rear end side with respect to the rear end of the first portion 70 at a predetermined distance in the axial direction. Moreover, it is desirable that the front end of the first inside-diameter portion 331A is disposed at a position on the front end side with respect to the front end of the first portion 70 at a predetermined distance in the axial direction.

The spark plug 301 configured as described above also attains an advantageous effect similar to that of the spark plug 1 (FIG. 2) in regard to the feature similar to that of the spark plug 1.

In the spark plug 301, the first inside-diameter portion 331A is "an inside-diameter portion having an inside diameter that is the largest in a portion of the metal shell 330 disposed in the region AR (FIG. 1)", and such an inside-diameter portion is disposed on the outer periphery of the first portion 70. Thus, in the vicinity of the first portion 70, the distance between the metal shell 30 and the center electrode 50 is further largely ensured in the radial direction because of the presence of the first inside-diameter portion 331A (the inside-diameter portion). Similarly, a distance Z3 between the metal shell 30 and the front seal member 62 in the radial direction is further largely ensured. As a result, electrostatic capacity is further suppressed. Accordingly, wear of the center electrode 50 and the ground electrode 42 can be further suppressed. In the spark plug 301, the first inside-diameter portion 331A (the portion having the largest inside diameter) is provided not in the entirety of the region AR (FIG. 1), but is selectively provided only in a portion of the region AR. Hence, a decrease in the strength of the metal shell 30 is suppressed compared with a configuration in which the first inside-diameter portion 331A is provided in the whole range of the region AR (FIG. 1).

Other Embodiment

The resent invention is not limited to aspects and modifications of the embodiments of the specification, and can be implemented by various configurations within the scope not departing from the gist of the present invention. For example, the technical features in the embodiments, examples, and modifications corresponding to the technical features in the aspects described in the section of Summary of Invention can be exchanged or combined if needed to address part or the entirety of the above-described problems or to attain part or the entirety of the above-described advantageous effects. In particular, the various technical features according to the above-described embodiments or embodiments which will be described later can be combined in a desirable way within a range involving no contradiction. When the technical features are not described as being essential in the specification, the technical features can be omitted if needed. The modifications include, for example, the following modifications.

Figure 5:
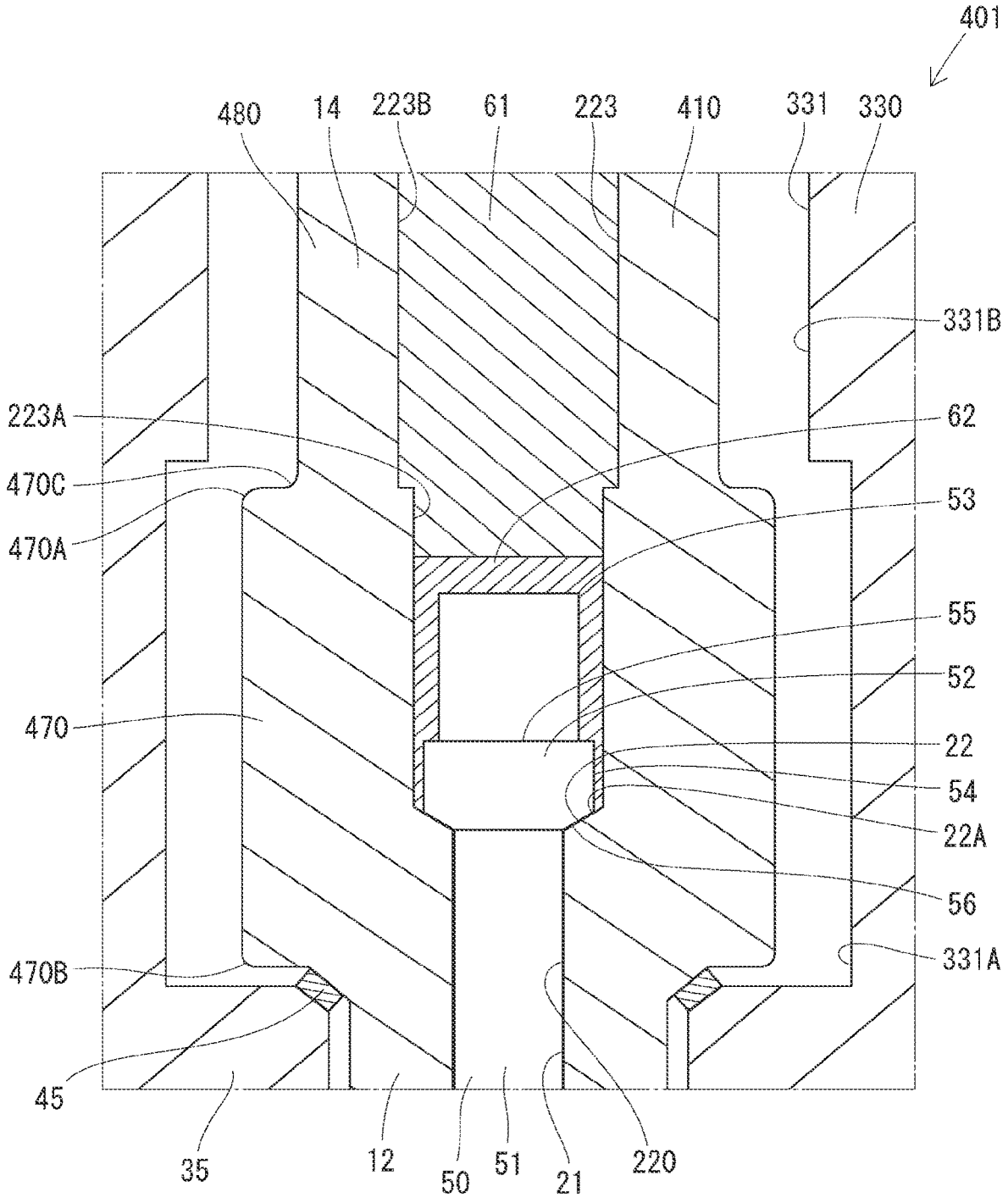
FIG. 5 is an enlarged sectional view illustrating part of a spark plug according to a first modification of other embodiment in an enlarged manner.

In the above-described embodiments, the front end or the rear end of the outer peripheral surface of the first portion, or the front end of the outer peripheral surface of the second portion is constituted as an angular corner portion (edge portion). However, such a corner portion may be chamfered to be round, for example, like a spark plug 401 illustrated in FIG. 5. With this configuration, no angular portion have to be provided in the vicinity of the first portion (the large-diameter portion) of the insulator, which is advantageous in terms of strength. The spark plug 401 illustrated in FIG. 5 is the same as the spark plug 301 according to the third embodiment except that the insulator 210 (FIG. 4) is changed to an insulator 410. Specifically, a first portion 470 is the same as the first portion 270 of the spark plug 301 (FIG. 4) except that a round portion 470A is provided at the outer peripheral edge of the rear end of the outer peripheral surface of the first portion 470 and a round portion 470B is provided at the outer peripheral edge of the front end of the outer peripheral surface of the first portion 470. A second portion 480 is the same as the second portion 80 of the spark plug 301 (FIG. 4) except that a round portion 470C is provided. The round portion 470A, the round portion 470B, and the round portion 470C are portions chamfered to be round.

In the above-described embodiments, the rear end of the first portion is located on the rear end side with respect to the rear end of the front seal member 62 (the front end of the resistor 61). However, it is sufficient that the first portion is disposed on the outer periphery of the large-diameter portion 52. For example, the rear end of the first portion may be located in the range of the head portion in the axial direction.

Figure 6:
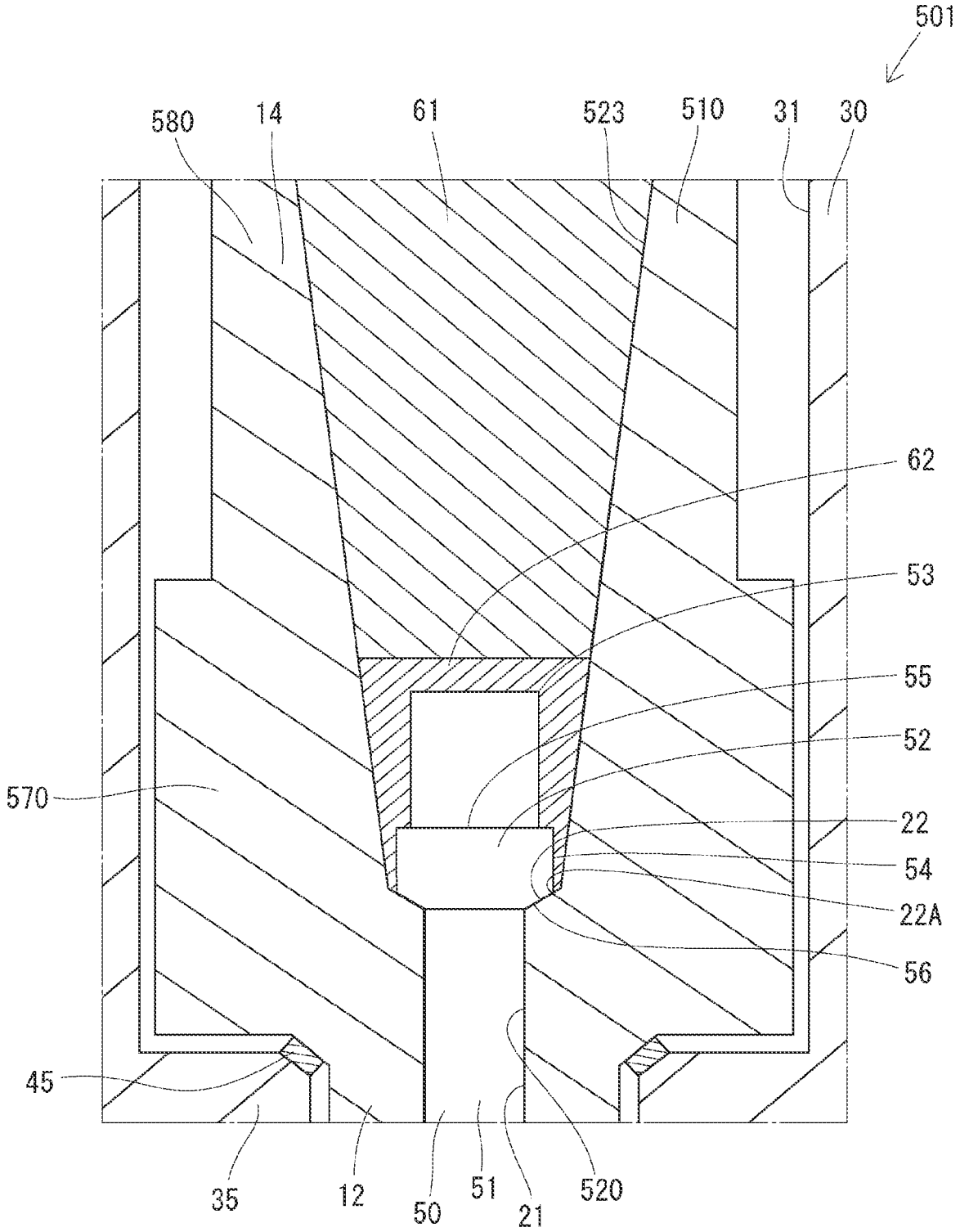
FIG. 6 is an enlarged sectional view illustrating part of a spark plug according to a second modification of other embodiment in an enlarged manner.

According to the second and third embodiments and so forth, the step is formed at the boundary between the inner peripheral surface of the first portion 270 and the inner peripheral surface of the second portion 80. However, like a spark plug 501 illustrated in FIG. 6, for example, an inner peripheral surface may be slanted to extend from a first portion 570 to a second portion 580. In the example in FIG. 6, the inner peripheral surface of a large-diameter hole portion 523 has a tapered shape having an inside diameter that is increased from the front end side toward the rear end side. Thus, since the inner peripheral surface of the insulator has no step, stress concentration is reduced, which is advantageous in terms of strength. The spark plug 501 illustrated in FIG. 6 is the same as the spark plug 1 (FIG. 2) except that the insulator 10 (FIG. 2) is changed to an insulator 510. Specifically, the configuration is the same as the configuration in FIG. 2 except that the axial hole 20 is changed to an axial hole 520 (more specifically, that the large-diameter hole portion 23 is changed to the large-diameter hole portion 523). The first portion 570 is the same as the first portion 70 in FIG. 2 except for the shape of the inner peripheral surface. The second portion 580 is the same as the second portion 80 in FIG. 2 except for the shape of the inner peripheral surface. The slant of the inner peripheral surface of the large-diameter hole portion 523 is desirably determined such that, for example, the angle of the inner peripheral surface of the large-diameter hole portion 523 with respect to the axial line X is larger than 0 degrees and smaller than 20 degrees in part or the entirety of the region AR (FIG. 1) in a cut section in any direction passing through the axial line X.

Figure 7:
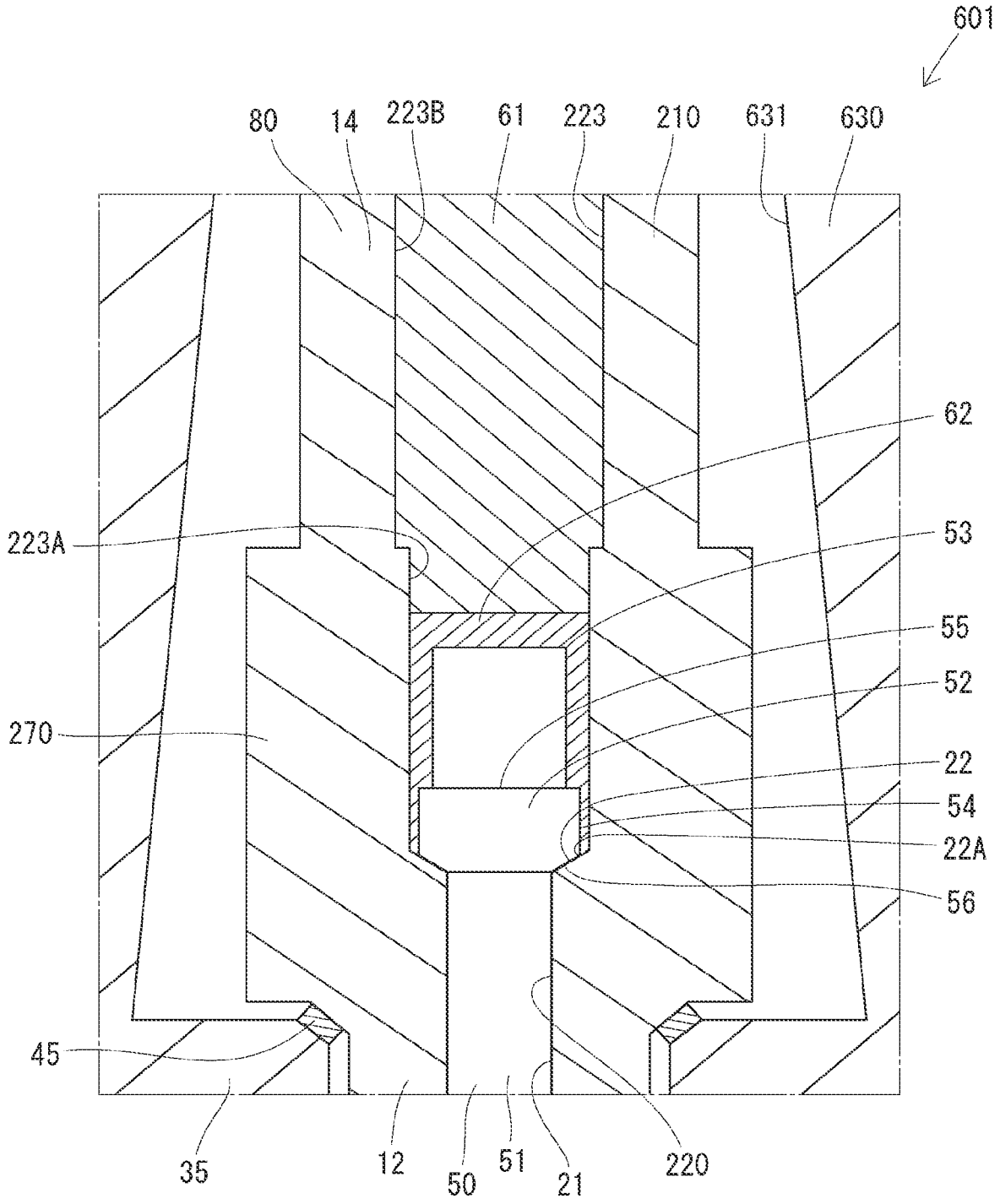
FIG. 7 is an enlarged sectional view illustrating part of a spark plug according to a third modification of other embodiment in an enlarged manner.

According to the third embodiment and so forth, the step is formed at the boundary between the inner peripheral surface of the first inside-diameter portion and the inner peripheral surface of the second inside-diameter portion of the metal shell. However, like a spark plug 601 illustrated in FIG. 7, for example, an inner peripheral surface of the metal shell on the rear end side with respect to the projecting portion 35 may have a tapered shape having an inside diameter that is gradually decreased toward the rear end side. With such a configuration, stress concentration is reduced, which is advantageous in terms of strength. Moreover, the inside diameter of the metal shell in the vicinity of the large-diameter portion 52 can be made relatively large, and the inside diameter of the metal shell on the rear end side can be made relatively small. This is advantageous in terms of preventing spark penetration, and is also advantageous in terms of increasing the strength on the rear end side. The spark plug 601 illustrated in FIG. 7 is the same as the spark plug 1 according to the first embodiment except that the metal shell 30 (FIG. 2) is changed to a metal shell 630. Specifically, the configuration is the same as the configuration in FIG. 2 except that the through hole 31 is changed to a through hole 631. The slant of the inner peripheral surface of the through hole 631 is desirably determined such that, for example, the angle of the inner peripheral surface of the through hole 631 with respect to the axial line X is larger than 0 degrees and smaller than 20 degrees in part or the entirety of the region AR (FIG. 1) in a cut section in any direction passing through the axial line X.

REFERENCE SIGNS LIST

1, 201, 301, 401, 501, 601 spark plug
10, 210, 410, 510 insulator
13 step portion
20, 220, 520 axial hole
22A rear facing surface
30, 330, 630 metal shell
36 diameter increased portion
45 packing
50 center electrode
52 large-diameter portion
70, 270, 470, 570 first portion
80, 480, 580 second portion
X axial line
AR region

What is claimed is:

1. A spark plug comprising:
a cylindrical insulator having an axial hole extending in an axial direction and a rear facing surface formed in the axial hole;
a cylindrical metal shell disposed on an outer periphery of the insulator; and
a center electrode disposed on a front end side in the axial hole,
the center electrode having a large-diameter portion having an outside diameter that is the largest in the center electrode, the large-diameter portion being retained at the rear facing surface, and
the metal shell having a diameter increased portion on a rear end side with respect to the center electrode, the diameter increased portion having an inside diameter that is increased toward the rear end side, wherein
the insulator has a first portion that includes a portion of the insulator in a region from a rear end of the rear facing surface of the insulator to a front end of the diameter increased portion of the metal shell,
the first portion has a thickness that is the largest in the region, and is disposed at least on an outer periphery of a whole range in the axial direction of the center electrode in the region,
the insulator is retained at the metal shell via a packing, on the front end side with respect to the first portion, and
the insulator has a second portion on the rear end side with respect to the first portion in the region, the second portion having an outside diameter that is smaller than an outside diameter of the first portion,
wherein the thickness of the insulator for the entirety of the first portion is greater than a thickness of the second portion.

2. The spark plug according to claim 1, wherein an inside diameter of the insulator is the smallest in the first portion in the region.

3. The spark plug according to claim 2, wherein
the metal shell has an inside-diameter portion that is a portion of the metal shell in the region, and
the inside-diameter portion has an inside diameter that is the largest in the region, and is disposed at least on an outer periphery of the first portion.

4. The spark plug according to claim 3, wherein
a portion in the axial hole, on the rear end side with respect to the rear facing surface, is filled with a front seal member that is in contact with an inner peripheral surface of the insulator and the center electrode and that contains an electrically conductive material, and
the first portion is disposed at least in a region from the rear end of the rear facing surface to a rear end of the front seal member.

5. The spark plug according to claim 2, wherein
a portion in the axial hole, on the rear end side with respect to the rear facing surface, is filled with a front seal member that is in contact with an inner peripheral surface of the insulator and the center electrode and that contains an electrically conductive material, and
the first portion is disposed at least in a region from the rear end of the rear facing surface to a rear end of the front seal member.

6. The spark plug according to claim 1, wherein
the metal shell has an inside-diameter portion that is a portion of the metal shell in the region, and
the inside-diameter portion has an inside diameter that is the largest in the region, and is disposed at least on an outer periphery of the first portion.

7. The spark plug according to claim 6, wherein
a portion in the axial hole, on the rear end side with respect to the rear facing surface, is filled with a front seal member that is in contact with an inner peripheral surface of the insulator and the center electrode and that contains an electrically conductive material, and
the first portion is disposed at least in a region from the rear end of the rear facing surface to a rear end of the front seal member.

8. The spark plug according to claim 1, wherein
a portion in the axial hole, on the rear end side with respect to the rear facing surface, is filled with a front seal member that is in contact with an inner peripheral surface of the insulator and the center electrode and that contains an electrically conductive material, and
the first portion is disposed at least in a region from the rear end of the rear facing surface to a rear end of the front seal member.

* * * * *